US009857070B1

(12) United States Patent
Zhou

(10) Patent No.: US 9,857,070 B1
(45) Date of Patent: Jan. 2, 2018

(54) WATERPROOF LED LAMP THAT IS DAMP-PROOF, CORROSION RESISTANT, AND HAS EXCELLENT HEAT DISSIPATION CHARACTERISTICS

(71) Applicant: Peng Zhou, Shenzhen (CN)

(72) Inventor: Peng Zhou, Shenzhen (CN)

(73) Assignee: Shenzhen Hipower Optoelectronic Co., Ltd., Shenzhen (CN)

( * ) Notice: Subject to any disclaimer, the term of this patent is extended or adjusted under 35 U.S.C. 154(b) by 0 days.

(21) Appl. No.: 15/372,120

(22) Filed: Dec. 7, 2016

(30) Foreign Application Priority Data

Jul. 6, 2016 (CN) ..... 2016 1 0525514

(51) Int. Cl.

| | |
|---|---|
| ***F21V 29/00*** | (2015.01) |
| ***F21V 31/00*** | (2006.01) |
| ***F21V 23/06*** | (2006.01) |
| ***F21V 23/00*** | (2015.01) |
| ***F21V 15/01*** | (2006.01) |
| ***F21V 19/00*** | (2006.01) |
| ***F21V 5/04*** | (2006.01) |
| ***F21V 29/83*** | (2015.01) |
| ***F21V 17/12*** | (2006.01) |

(Continued)

(52) U.S. Cl.

CPC ..... *F21V 31/005* (2013.01); *F21V 5/04* (2013.01); *F21V 15/01* (2013.01); *F21V 17/12* (2013.01); *F21V 19/005* (2013.01); *F21V 23/001* (2013.01); *F21V 23/005* (2013.01); *F21V 23/023* (2013.01); *F21V 23/06* (2013.01); *F21V 29/74* (2015.01); *F21V 29/83* (2015.01); *F21Y 2115/10* (2016.08)

(58) Field of Classification Search

CPC ..... F21V 31/005; F21V 23/005; F21V 29/74; F21V 17/12; F21V 29/83; F21V 5/04; F21V 23/023; F21V 19/005; F21V 15/01; F21V 23/001; F21V 23/06; F21Y 2115/10

See application file for complete search history.

(56) References Cited

U.S. PATENT DOCUMENTS

| | | | | |
|---|---|---|---|---|
| 9,512,969 | B1 * | 12/2016 | Watson | G03B 15/02 |
| 2009/0180281 | A1 * | 7/2009 | Ahland, III | F21V 7/0083 362/234 |
| 2014/0185303 | A1 * | 7/2014 | Shao | F21V 1/00 362/311.02 |

* cited by examiner

*Primary Examiner* — Tracie Y Green

(57) ABSTRACT

This new utility invention discloses a waterproof LED lamp comprising a power supply box and an LED lighting module block detachably connected to the power supply box. A power driving board and an LED controller are disposed in the power supply box. The LED lighting module block includes at least one LED module, which includes a module heat dissipater. The power supply box and the LED module are arrayed side-by-side in a parallel manner, and a lateral surface of the power supply box matches a lateral surface of the LED module in size and shape so that the power supply box and the LED module may be in close contact. The power supply box and the LED lighting module block are electrically connected with a conducting wire, which is arranged to go through the wiring hole and the slot. The power driving board provides power to the LED controller and the light board, and the LED controller drives the LED lighting beads on the light board to illuminate. The present invention disposes the power supply and power driver inside a power supply box to separate the power supply from the LED light source. For product maintenance, the power supply or LED light source may be replaced individually.

8 Claims, 13 Drawing Sheets

(51) Int. Cl.

| | |
|---|---|
| ***F21V 29/74*** | (2015.01) |
| ***F21V 23/02*** | (2006.01) |
| *F21Y 115/10* | (2016.01) |

WATERPROOF LED LAMP THAT IS DAMP-PROOF, CORROSION RESISTANT, AND HAS EXCELLENT HEAT DISSIPATION CHARACTERISTICS

BACKGROUND OF THE INVENTION

1. Field of the Invention

The present invention relates to the technical field of lamp manufacturing, and particularly relates to a waterproof and damp-proof LED lamp for outdoor use.

2. Description of Related Art

Heat dissipation has become a major constraint that may restrict LED application because the performance and use life of an LED are in inverse relation with its operating junction temperature, and because over 80% of an LED's electric energy is converted into thermal energy. Conventional outdoor LED lamps are usually provided with heat dissipating plates for heat dissipation. A conventional heat dissipating plate is usually designed as closed on one end, with another end exposed and pointing upwards. With this design, dust may easily fall upon the heat dissipating plate, accumulate overtime and impair heat dissipation. Further, when a conventional outdoor LED lamp is used outdoors for a long period of time, there may easily be problems of bird nesting and piling up of droppings and dead insects drawn to its light on its heat dissipater. This may greatly impair the heat dissipating efficiency of the heat dissipater.

In addition, waterproof function is especially important with LED lamps for outdoor use. Conventional outdoor LED lamps have exposed wires. When conventional LED lamps are used indoors, their exposed wires may easily be corroded by chemical contents used in the industrial field. When they are used outdoors, their wires may be corroded and damaged from exposure to the sun and acid rain. To provide a conventional LED lamp with waterproof function, a coating of sealer is usually applied to an electrical circuit board of the LED to prevent water permeation and resulting damage to the electrical circuit. There are, however, several drawbacks to this method: (1) The coating of sealer affects the heat dissipating performance of the LED electrical circuit board, whereas an LED lamp generates a large amount of heat when operating and inefficient heat dissipation may reduce its use life. (2) Further, with the increase of usage time and under the impact of thermal expansion and cold shrinkage, the waterproof function of the sealer may diminish. (3) The coating of sealer may also change the original optical properties of the LED lamp.

Further, the modules of conventional outdoor LED lamps are usually fixed and unchangeable. They are low-power, complicated to assemble, costly to manufacture, and their application restricted to only one single place.

SUMMARY OF THE INVENTION

Therefore, to address the foregoing issues, the present invention provides a waterproof LED lamp which may avoid accumulation of fallen dust, bird nesting and piling up of dead insects thereon and improves upon the structure of its housing so that it has excellent heat dissipating performance and is waterproof, damp-proof and corrosion resistant. Further, the LED module provided by the present invention may be disassembled and assembled to provide various powers and to be applicable on various occasions.

To address the foregoing technical issues, the present invention adopts the following technical scheme: a waterproof LED lamp comprises a power supply box and an LED lighting module block detachably connected to the power supply box; a power driving board and an LED controller are disposed in the power supply box; the LED lighting module block includes at least one LED module, which includes a module heat dissipater; a light board and a module projecting lens are successively disposed on top of the module heat dissipater and a dust-proof cover is disposed below the module heat dissipater; the power supply box and the LED module are arrayed side-by-side in a parallel manner, and a lateral surface of the power supply box matches a lateral surface of the LED module in size and shape so that the power supply box and the LED module may be in close contact; more specifically, a lateral surface of the power supply box (the lateral surface in contact with the LED module) is provided with male connectors and a wiring hole, while a lateral surface of the LED module (the lateral surface in contact with the power supply box) is provided with female connectors mating with the male connectors and a slot mating with a corresponding wiring hole; the power supply box and the LED module are fixedly connected by plugging the female connectors into the male connectors; and the power supply box and the LED lighting module block are electrically connected with a conducting wire, which is arranged to go through the wiring hole and the slot, the power driving board provides power to the LED controller and the light board, and the LED controller drives the LED lighting beads on the light board to illuminate. The present invention disposes the power supply and power driver inside a power supply box to separate the power supply from the LED light source. For product maintenance, the power supply or LED light source may be replaced individually.

Further, to provide various powers to meet the requirements on various occasions, the LED lighting module block comprises N LED modules, N>1. The LED modules are arrayed side-by-side in a parallel manner, and the successively connected LED modules are respectively called a first LED module, a second LED module . . . and an N LED module. On a left lateral surface of the first LED module are disposed female connectors mating with the male connectors disposed on a lateral surface of the power supply box, and a slot mating with a corresponding wiring hole. On a right lateral surface of the first LED module are disposed male connectors and a wiring hole. In a similar fashion, on a left lateral surface of the N LED module are disposed female connectors mating with the male connectors disposed on a right lateral surface of the N−1 LED module, and a slot mating with a corresponding wiring hole. On a right lateral surface of the N−1 LED module are disposed male connectors and a wiring hole. To facilitate manufacturing, the first LED module, the second LED module . . . and the N−1 LED module share a same structure. Also, to ensure closure, a right lateral surface of the N LED module is shaped as a closed plane. The LED modules have a same internal circuit structure providing a same power. When using an LED lamp according to the present invention, a certain number of LED modules may be selected as is required and connected successively. They are easy to use and easy to assemble and disassemble.

Further, to provide waterproof function, the male connectors of the power supply box and the female connectors of the LED module are connected with mortises and tenons. This manner of connection may effectively restrict torsion in all directions of an interface between the male and female connectors, making the connection more robust and providing an excellent waterproof effect. Also, an elastic rubber ring is disposed on the wiring hole of the power supply box and the slot of the LED module. After a wire goes through the wiring hole, the elastic rubber ring seals up the wiring hole and the slot, making the entire power supply box an enclosed space to more effectively prevent water or dust from entering the power supply box along the wire. In addition, a projecting lens waterproof ring is disposed at a juncture between the module projecting lens and the light board.

To enhance the effect of heat dissipation, the power supply box is made of metal, and the metal of which the power supply box is made differs from the metal of which the module heat dissipater is made. Typically, the module heat dissipater is made of copper or aluminum, whereas the power supply box may be made of iron or iron alloy. Also, the power supply box and the module heat dissipater form a closed circuit with a conducting wire. After the waterproof LED lamp is powered up, according to the Peltier effect, heat on the light board is gradually transmitted to the power supply box via the module heat dissipater, which provides an excellent heat dissipating effect to the LED light board. This may not only prolong the use life of the LED but also provide damp-proof and corrosion resistant effects to the power supply box and ensure the safety and stability of the electrical circuit in the power supply box. Additionally, to prevent heat from accumulating between the power supply box and module heat dissipater that are in close contact, preferably a lateral wall of the power supply box (the side facing the module heat dissipater) is coated with a layer of N-typed semi-conductor cooling material (e.g. Bi—Sb alloy), and a lateral wall of the module heat dissipater is coated with a layer of P-typed semi-conductor cooling material (e.g. Ag(1−x)Cu(x)Ti Te). As proven by experiments, when opposing lateral walls of the power supply box and the module heat dissipater are respectively coated with N-typed and P-typed semi-conductor cooling materials, the heat dissipating performance is greatly enhanced. Also, there's no accumulation of heat in the interstices between the power supply box and the module heat dissipater.

To further enhance heat dissipating effect, as a specific scheme, the module heat dissipater comprises an extending heat dissipating section disposed along a circumference of the module heat dissipater and a central heat dissipating section surrounded by the extending heat dissipating section; disposed in the extending heat dissipating section are a plurality of through holes passing from the top through to the bottom (they may be circular or rectangular in shape or of any other shape); in the central heat dissipating section are disposed a plurality of heat dissipating fins, among which are interstices; the light board is fixed on an upper side of the central heat dissipating section, and the module projecting lens covers the light board; and the dust-proof cover is fixed to a bottom of the central heat dissipating section. With the foregoing arrangement, the present invention fixes the light board, module projecting lens and dust-proof cover on the central heat dissipating section to expose the extending heat dissipating section, which further enhances heat dissipating capacity and reduces accumulation of heat in the interstices between the power supply box and module heat dissipater.

Compared with conventional technologies, the scheme adopted in the present invention has the following advantages:

1. Excellent waterproof performance: The power supply and light source are designed as individual modules. A modular housing has excellent waterproof performance and the deployment of waterproof rings (power supply box waterproof ring, projecting lens waterproof ring, elastic rubber ring) further enhances the waterproof performance of the housing. In addition, the wiring arrangement between the power supply and the light source through wiring holes ensures the waterproof performance of the entire lamp. Further, a size and shape of a lateral side of the power supply box corresponds to a size and shape of a lateral side of the LED module so that the power supply box and the LED module may be in close contact to further enhance the waterproof performance. Also, the male connectors of the power supply box and the female connectors of the LED module are connected with mortises and tenons. This manner of connection is more robust and provides an excellent waterproof effect.

2. Excellent heat dissipating performance: The power supply box and the module heat dissipater form a closed circuit with a conducting wire. According to the Peltier effect, heat on the light board is gradually transmitted to the housing of the power supply box via the module heat dissipater, which provides an excellent heat dissipating effect to the LED light board. Further, an extending heat dissipating section and a central heat dissipating section are disposed in the module heat dissipater. A plurality of heat dissipating through holes are disposed all around the extending heat dissipating section and a plurality of heat dissipating fins are disposed in the central heat dissipating section. After assembly, the extending heat dissipating section is exposed, which further enhances heat dissipating performance and prevents accumulation of heat in the interstices between the power supply box and the module head dissipater in coordination with the foregoing Peltier effect.

3. Excellent expandability: The power supply and light source are modularly designed as a power supply box and an LED lighting module block, respectively. The power supply driving board and LED controller in the power supply box may be individually designed or replaced. For example, in the power supply box may be installed simultaneously an LED lightning protecting power supply, an LED lightning protecting device, an LED intelligent controller, an LED photosensor, etc. To use the LED lamp, simply connect all electrical components with conducting wires and power lines.

4. Wide application: The LED lighting module block comprises a plurality of LED modules, the number of which may be decided according to a user's need. It may be applied on various occasions in coordination with corresponding installation stands. For example, it may be made into an outdoor LED streetlamp, outdoor project lamp, tunnel lamp, bracket lamp, miner's lamp, etc. and be widely used on various occasions.

LEGEND

Figure 1:
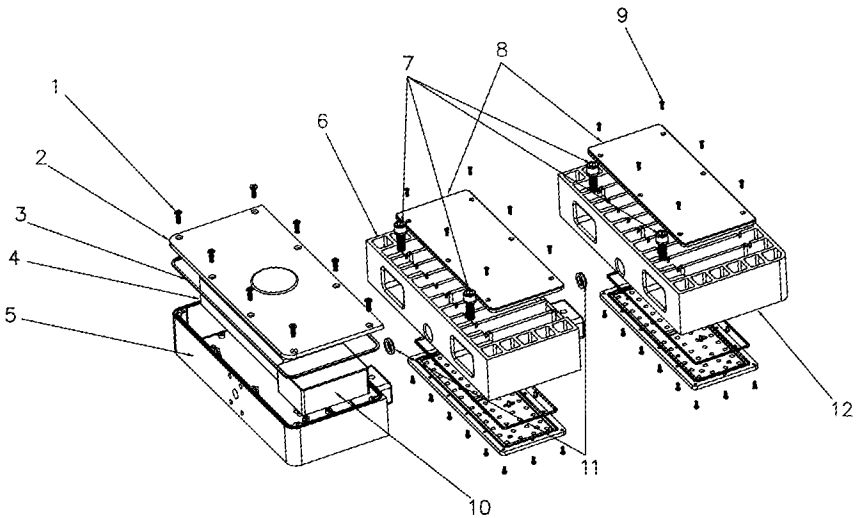
FIG. 1 is an exploded schematic bottom view of Embodiment 1 according to the present invention.
Figure 2:
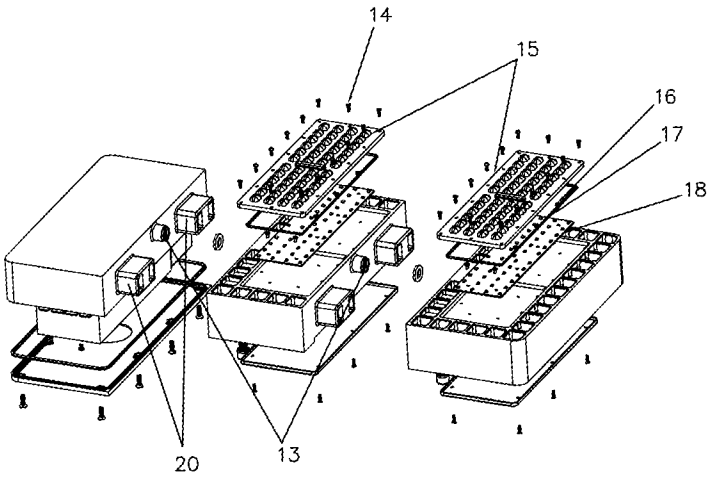
FIG. 2 is an exploded schematic top view of Embodiment 1 according to the present invention.
Figure 3:
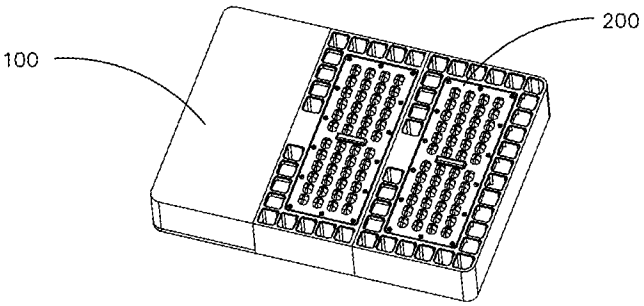
FIG. 3 is a three-dimensional schematic view of Embodiment 1 according to the present invention.
Figure 4:
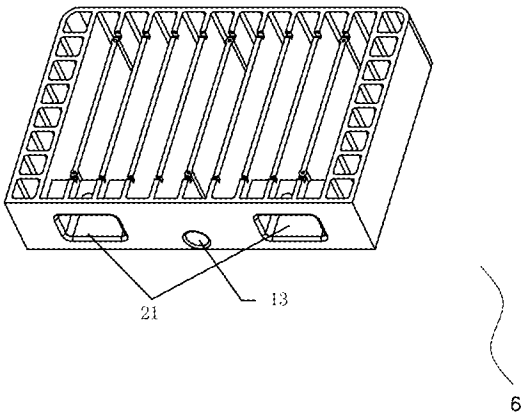
FIG. 4 is a three-dimensional schematic view of a module heat dissipater according to Embodiment 1 of the present invention.
Figure 5:
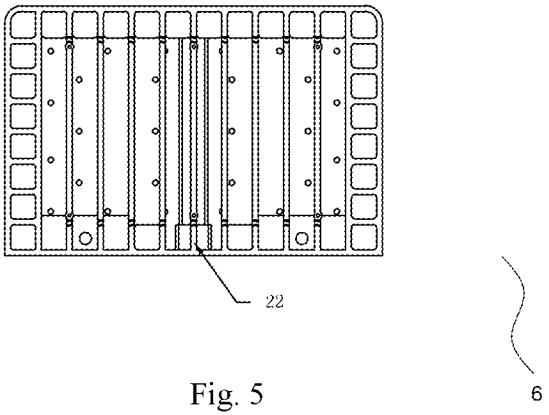
FIG. 5 is a top view of a module heat dissipater according to Embodiment 1 of the present invention.
Figure 6:
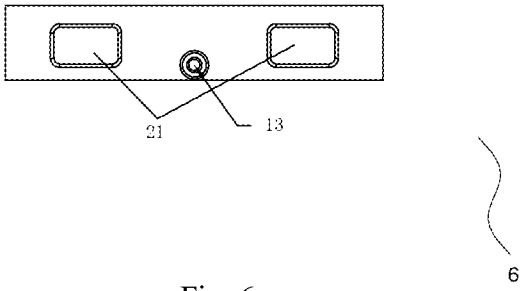
FIG. 6 is a front view of a module heat dissipater according to Embodiment 1 of the present invention.
Figure 7:
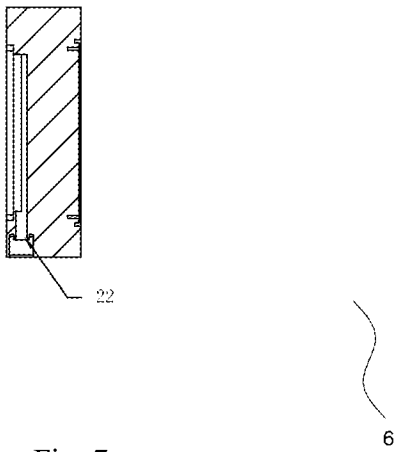
FIG. 7 is a cut-away side view of a module heat dissipater according to Embodiment 1 of the present invention.

1: power supply box retaining screws
2: power supply box rear cover
3: power supply box waterproof rings
4: power driver
5: power supply housing
6: first module heat dissipater
7: module retaining screws
8: dust-proof cover
9: dust-proof cover retaining screws
10: LED controller
11: elastic rubber rings
12: second module heat dissipater
13: wiring holes
14: projecting lens retaining screws
15: module projecting lens
16: light board retaining screws
17: projecting lens waterproof rings
18: light board
19: slots
20: male connectors
21: female connectors
22: wiring holes

DETAILED DESCRIPTION OF THE PREFERRED EMBODIMENTS

The present invention will be further illustrated in the detailed description of preferred embodiments given herein below and the accompanying drawings.

Embodiment 1

In a specific embodiment, a waterproof LED lamp according to the present invention comprises a power supply box 100 and an LED lighting module block 200 detachably connected to the power supply box 100. In this embodiment, the LED lighting module block 200 is provided with two LED modules, called respectively a first LED module and a second LED module.

Please refer to FIGS. 1 to 7. The power supply box 100 comprises power supply box retaining screws 1, a power supply box rear cover 2, a power supply box waterproof ring 3, a power supply driving board 4, an LED controller 10 and a power supply box housing 5. The power supply box rear cover 2 and the power supply box housing 5 are assembled to form a power supply box 100 with the power supply box retaining screws 1. The power supply box waterproof ring 3 prevents water from entering the power supply box 100, the power supply driving board 4 is used for providing power supply, and the LED controller 10 drives the lamp and performs network control.

The LED lighting module block 200 comprises a first module heat dissipater 6, module retaining screws 7, a dust-proof cover 8, dust-proof cover retaining screws 9, elastic rubber rings 11, a second module heat dissipater 12, wiring holes 13, slots 19, projecting lens retaining screws 14, module projecting lens 15, light board retaining screws 16, a projecting lens waterproof ring 17, and a light board 18. The first module heat dissipater 6 and the second module heat dissipater 12 provide heat dissipation. The number of LED modules may be increased to assemble lamps of various powers with module retaining screws 7 and by assembling and fixing the LED modules together.

A module heat dissipater comprises an extending heat dissipating section disposed along a circumference of the module heat dissipater and a central heat dissipating section surrounded by the extending heat dissipating section. Disposed in the extending heat dissipating section is a plurality of through holes passing from the top through to the bottom (they may be circular or rectangular in shape or of any other shape). In the central heat dissipating section are disposed a plurality of heat dissipating fins, among which there are interstices. The light board is fixed on an upper side of the central heat dissipating section, and the module projecting lens covers the light board; and the dust-proof cover is fixed to a bottom of the central heat dissipating section. The dust-proof cover 8 is fixed to the heat dissipater (the heat dissipater in the present embodiment refers to the first module heat dissipater or the second module heat dissipater) with the dust-proof cover retaining screws 9. The dust-proof cover 8 protects the heat dissipating fins of the central heat dissipating section and avoids the impact of bird nesting, droppings and piling up of miscellaneous objects on its heat dissipating performance. The wiring holes 13 and slots 19 are correspondingly disposed for internal wiring of the lamp to prevent wires from being exposed, which may cause aging or damage. Further, to avoid disorderly internal wiring, a wiring groove 22 is formed between the wiring hole 13 and slot 19. An output wire of power supply and other conducting wires may be connected to the light board 18 of the LED module via the channel formed by the wiring groove 22 to prevent the output wire from exposure to outer environment and to prevent damage from exposure to ultraviolet rays, rain, and acid-base in the outer environment. On the wiring hole 13 of the power supply box and the slot of the LED module is disposed an elastic rubber ring 11. After a wire passes through the wiring hole 13, the elastic rubber ring 11 seals up the wiring hole 13 and the slot 19 to make the entire power supply box a closed space and better prevent water or dust from entering the power supply box through the wiring hole 13. In addition, at a juncture between the module projecting lens 15 and the light board 18 is disposed a projecting lens waterproof ring 17 to further enhance the waterproof performance.

The light board 18 is fixed to the heat dissipater with the light board retaining screws 16. The module projecting lens 15 is fixed to the heat dissipater with the projecting lens retaining screws 14 and the projecting lens waterproof ring 17. Also, the module projecting lens 15 covers the light board 18. The module projecting lens 15 is used to increase the light-emitting efficiency of the lamp and optimizes its spectrum curve. The module projecting lens 15 may also be fixed to the light board 18, as long as it is disposed on the LED lighting beads of the light board 18. The light board 18 is in direct contact with the heat dissipater so that the heat content of the light board 18 is rapidly directed into the heat dissipater. The projecting lens waterproof ring 17 is used for preventing water from entering the installation interstices between the projecting lens and heat dissipater. LED lighting beads are disposed on the light board 18, which is fixed to the heat dissipater. The LED lighting beads are welded on the light board 18. The light board 18 is used for providing light output.

Waterproof function is particularly essential to LED lamps for outdoor use. To achieve a waterproof effect, the power supply box and the LED module are arrayed side-by-side in a parallel manner. A lateral surface of the power supply box matches a lateral surface of the LED module in size and shape so that the power supply box and the LED module may be in close contact. More specifically, a lateral surface of the power supply box (the lateral surface in contact with the LED module) is provided with male connectors 20 and a wiring hole 13. Take the first module heat dissipater for example. Please refer to FIGS. 4 to 7. A lateral surface of the first module heat dissipater 6 (the lateral surface in contact with the power supply box) is provided with female connectors 21 mating with the male connectors 20 and a slot 19 mating with a corresponding wiring hole 13. The power supply box and the LED module are fixedly connected by plugging the female connectors 21 into the male connectors 20. To achieve a waterproof effect, the male connectors 20 of the power supply box and the female connectors 21 of the LED module are connected with mortises and tenons. That is, the male connectors 20 and the female connectors 21 may be connected with mortises and tenons, with the male connectors 20 as tenons and the female connectors 21 as mortises. This means that the power supply box is provided with tenons (one or more tenons, two tenons are disposed in the present embodiment), and a left side of the first LED module is provided with corresponding mortises to be connected with the power supply box. A right side of the first LED module is provided with tenons, and a left side of the second LED module is provided with corresponding mortises to be connected with the first LED module. A right side of the second LED module is closed. When connecting a plurality of LED modules, of course a right lateral wall of the last LED is closed and the other LED modules are structured as the foregoing. This kind of mortise and tenon connection may effectively restrict torsion in all directions of an interface between the male and female connectors, making the connection more robust and providing an excellent waterproof effect.

The power supply box and the LED lighting module block are electrically connected with a conducting wire, which is arranged to go through the wiring hole 13 and the slot 19. The power driving board 4 provides power to the LED controller 10 and the light board 18. The LED controller 10 drives the LED lighting beads on the light board 18 to illuminate. The present invention disposes the power supply and power driver inside a power supply box to separate the power supply from the LED light source. For product maintenance, the power supply or LED light source may be replaced individually.

Embodiment 2

To provide various powers to meet the requirements on various occasions, the LED lighting module block comprises N LED modules, N>1. The LED modules are arrayed side-by-side in a parallel manner, and the successively connected LED modules are respectively called a first LED module, a second LED module . . . and an N LED module. On a left lateral surface of the first LED module are disposed female connectors 21 mating with the male connectors 20 disposed on a lateral surface of the power supply box, and a slot 19 mating with a corresponding wiring hole 13. On a right lateral surface of the first LED module are disposed male connectors 20 and a wiring hole 13. In a similar fashion, on a left lateral surface of the N LED module are disposed female connectors 21 mating with the male connectors 20 disposed on a right lateral surface of the N−1 LED module, and a slot 19 mating with a corresponding wiring hole 13. On a right lateral surface of the N−1 LED module are disposed male connectors 20 and a wiring hole 13. To facilitate manufacturing, the first LED module, the second LED module . . . and the N−1 LED module share a same structure. Also, to ensure closure, a right lateral surface of the N LED module is shaped as a closed plane. The LED modules have a same internal circuit structure providing a same power. When using an LED lamp according to the present invention, a certain number of LED modules may be selected as is required and connected successively. They are easy to use and easy to assemble and disassemble.

Figure 8:
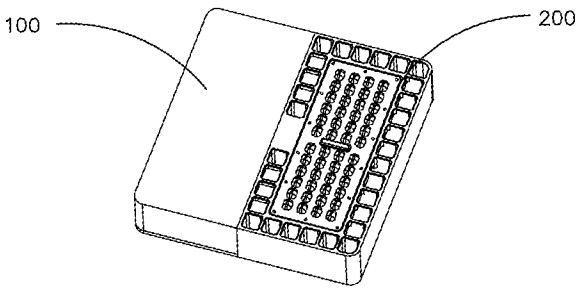
FIG. 8 is a three-dimensional schematic view of Embodiment 2 according to the present invention.

In the present embodiment as illustrated in FIG. 8, the LED lighting module block includes one LED module.

Embodiment 3

Figure 9:
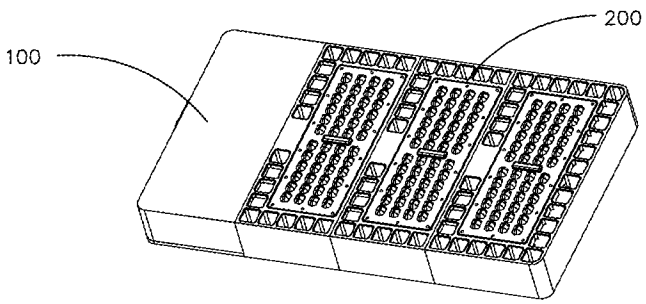
FIG. 9 is a three-dimensional schematic view of Embodiment 3 according to the present invention.

In the present embodiment as illustrated in FIG. 9, the LED lighting module block includes three LED modules.

The use life of an LED lamp is closely related to its heat dissipating performance. To further achieve damp-proof and corrosion resistant effects, the power supply box is made of metal, and the metal of which the power supply box is made differs from the metal of which the module heat dissipater is made. Typically, the module heat dissipater is made of copper or aluminum, whereas the power supply box may be made of iron or iron alloy. Also, the power supply box and the module heat dissipater form a closed circuit with a conducting wire. After the waterproof LED lamp is powered up, according to the Peltier effect, heat on the light board 18 is gradually transmitted to the power supply box via the module heat dissipater, which provides an excellent heat dissipating effect to the LED light board 18. This may not only prolong the use life of the LED but also provide damp-proof and corrosion resistant effects to the power supply box and ensure the safety and stability of the electrical circuit in the power supply box. Additionally, to prevent heat from accumulating between the power supply box and module heat dissipater that are in close contact, preferably a lateral wall of the power supply box (the side facing the module heat dissipater) is coated with a layer of N-typed semi-conductor cooling material (e.g. Bi—Sb alloy), and a lateral wall of the module heat dissipater is coated with a layer of P-typed semi-conductor cooling material (e.g. Ag(1−x)Cu(x)Ti Te). As proven by experiments, when opposing lateral walls of the power supply box and the module heat dissipater are respectively coated with N-typed and P-typed semi-conductor cooling materials, the heat dissipating performance is greatly enhanced. Also, there's no accumulation of heat in the interstices between the power supply box and the module heat dissipater. Further, with the foregoing arrangement, the present invention fixes the light board, module projecting lens and dust-proof cover on the central heat dissipating section to expose the extending heat dissipating section, which further enhances heat dissipating capacity and reduces accumulation of heat in the interstices between the power supply box and module heat dissipater.

Figure 10:
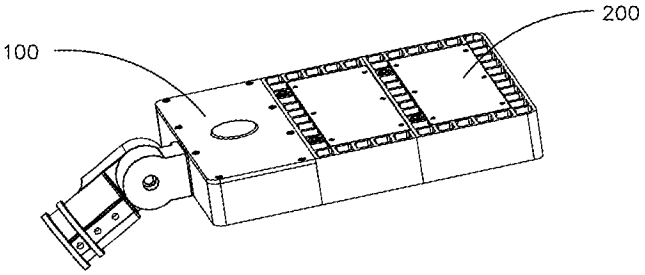
FIG. 10 is Application Example 1 according to the present invention.
Figure 11:
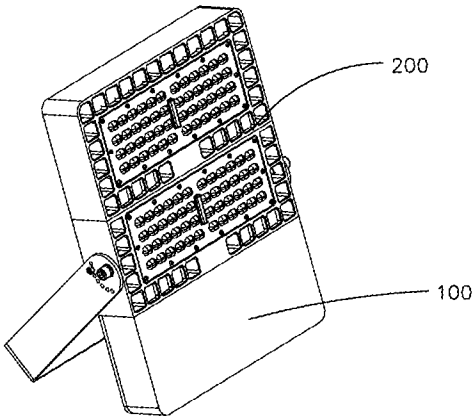
FIG. 11 is Application Example 2 according to the present invention.
Figure 12:
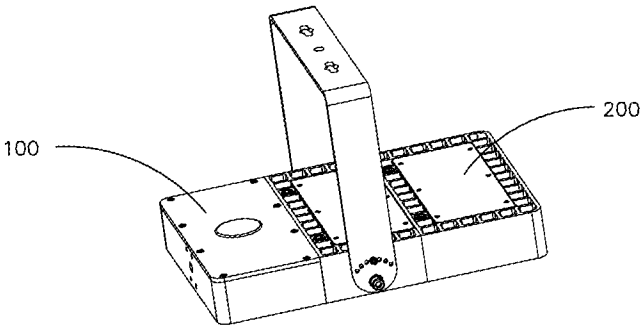
FIG. 12 is Application Example 3 according to the present invention.
Figure 13:
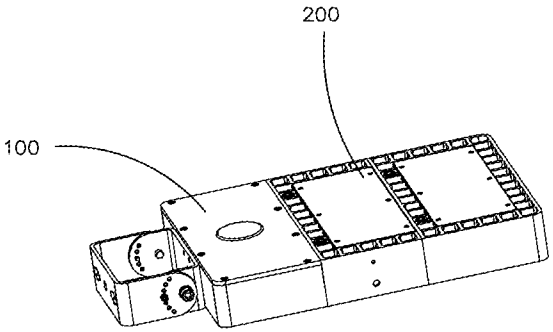
FIG. 13 is Application Example 4 according to the present invention.

As the foregoing, the present invention adopts the foregoing scheme to provide a modular LED lamp that has excellent heat dissipating performance, wide application, high power and excellent waterproof performance. When using an LED lamp according to the present invention, the number of LED modules may be decided according to a user's need. It may be applied on various occasions in coordination with corresponding installation stands. Take FIG. 10 for example, the entire lamp may be made into a streetlamp when equipped with a streetlamp pivoted arm. Take FIG. 11 for example, the entire lamp may be made into a floodlight when equipped with a floodlight stand. Also take the tunnel lamp/miner's lamp in FIG. 12 and the bracket lamp in FIG. 13 for examples.

The foregoing preferred embodiments of the present invention are illustrated of the present invention rather than limiting of the present invention. It is intended to cover various modifications and changes included within the spirit and scope of the appended claims, the scope of which should be accorded the broadest interpretation so as to encompass all such modifications and similar structures.

What is claimed is:

1. A waterproof LED lamp, comprising:

a power supply box and an LED lighting module block detachably connected to the power supply box; a power driving board and an LED controller are disposed in the power supply box; the LED lighting module block includes at least one LED module, which includes a module heat dissipater; a light board and a module projecting lens are successively disposed on top of the module heat dissipater and a dust-proof cover is disposed below the module heat dissipater;

the power supply box and the LED module are arrayed side-by-side in a parallel manner, and a lateral surface of the power supply box matches a lateral surface of the LED module in size and shape so that the power supply box and the LED module may be in close contact, and more specifically, a lateral surface of the power supply box is provided with male connectors and a wiring hole, while a lateral surface of the LED module is provided with female connectors mating with the male connectors and a slot mating with the wiring hole, and the power supply box and the LED module are fixedly connected by plugging the female connectors into the male connectors; and the power supply box and the LED lighting module block are electrically connected with a conducting wire, which is arranged to go through the wiring hole and the slot, the power driving board provides power to the LED controller and the light board, and the LED controller drives the LED lighting beads on the light board to illuminate.

2. A waterproof LED lamp of claim 1, wherein the LED lighting module block comprises N LED modules, N>1; the LED modules are arrayed side-by-side in a parallel manner, and the successively connected LED modules are respectively called a first LED module, a second LED module . . . and an N LED module; on a left lateral surface of the first LED module are disposed female connectors mating with the male connectors disposed on a lateral surface of the power supply box, and a slot mating with a corresponding wiring hole; on a right lateral surface of the first LED module are disposed male connectors and a wiring hole; in a similar fashion, on a left lateral surface of the N LED module are disposed female connectors mating with the male connectors disposed on a right lateral surface of the N−1 LED module, and a slot mating with a corresponding wiring hole; and on a right lateral surface of the N−1 LED module are disposed male connectors and a wiring hole.

3. A waterproof LED lamp of claim 1, wherein the power supply box is made of metal, and the metal of which the power supply box is made differs from the metal of which the module heat dissipater is made; and the power supply box and the module heat dissipater form a closed circuit with a conducting wire.

4. A waterproof LED lamp of claim 3, wherein a lateral wall of the power supply box is coated with a layer of N-typed semi-conductor cooling material, and a lateral wall of the module heat dissipater is coated with a layer of P-typed semi-conductor cooling material.

5. A waterproof LED lamp of claim 1, wherein the module heat dissipater comprises an extending heat dissipating section disposed along a circumference of the module heat dissipater and a central heat dissipating section surrounded by the extending heat dissipating section; disposed in the extending heat dissipating section are a plurality of through holes passing from the top through to the bottom; in the central heat dissipating section are disposed a plurality of heat dissipating fins, among which are interstices; the light board is fixed on an upper side of the central heat dissipating section, and the module projecting lens covers the light board; and the dust-proof cover is fixed to a bottom of the central heat dissipating section.

6. A waterproof LED lamp of claim 1, wherein the male connectors of the power supply box and the female connectors of the LED module are connected with mortises and tenons.

7. A waterproof LED lamp of claim 1, wherein an elastic rubber ring is further disposed on the wiring hole of the power supply box and the slot of the LED module.

8. A waterproof LED lamp of claim 1, wherein a projecting lens waterproof ring is disposed at a juncture between the module projecting lens and the light board.

* * * * *